United States Patent [19]

Rode

[11] Patent Number: 4,635,531

[45] Date of Patent: Jan. 13, 1987

[54] HYDRAULICALLY OPERATED IMPACTING DEVICE

[75] Inventor: Wilhelm Rode, Darmstadt, Fed. Rep. of Germany

[73] Assignee: Mannesmann AG, Duesseldorf, Fed. Rep. of Germany

[21] Appl. No.: 688,347

[22] Filed: Jan. 2, 1985

[30] Foreign Application Priority Data

Jan. 3, 1984 [DE] Fed. Rep. of Germany ..... 3400302

[51] Int. Cl.[4] ..... F01L 25/02

[52] U.S. Cl. ..... 91/303; 91/319; 91/321

[58] Field of Search ..... 91/281, 286, 303, 319, 91/276, 321, 327

[56] References Cited

U.S. PATENT DOCUMENTS

| | | | |
|---|---|---|---|
| 3,411,592 | 11/1968 | Montabert | 91/303 |
| 3,986,567 | 10/1976 | Pototsky | 91/303 |
| 4,011,795 | 3/1977 | Barthe | 91/286 |
| 4,022,108 | 5/1977 | Juvonen | 91/303 |
| 4,028,995 | 6/1977 | Salmi | 91/319 |
| 4,084,486 | 4/1978 | Juvonen | 91/321 |
| 4,142,447 | 3/1979 | Krasnoff | 91/327 |
| 4,143,585 | 3/1979 | Selsam | 91/319 |
| 4,165,788 | 8/1979 | Montabert | 91/319 |

*Primary Examiner*—Abraham Hershkovitz
*Attorney, Agent, or Firm*—Ralf H. Siegemund

[57] ABSTRACT

A hydraulically operated impacting device includes a differential piston slidably disposed in a bore, and having an impacting surface and a piston rod facing at the other end a valve sleeve circumscribing the piston rod, there being an annular space between the rod and the valve, the valve having a first and a second position; a first duct leads from a pressure source to the bore and is governed by the valve for acting or not acting on the larger one of the two piston surfaces respectively in the first and second positions of the valve; a second duct leads from the source to the bore for acting on the smaller one of the piston surfaces; a third duct leads from the bore at a location below the valve to a ring chamber adjacent the valve, the valve having a collar which is movable in the ring chamber, the piston has a portion which depending on the position of the piston permits or prevents communication between the annular space and the third duct to obtain or not obtain pressurization of the ring chamber for shifting the valve from the first to the second position; the piston has a collar which may enter in part the annular space during a return stroke of the piston while the remainder of the collar and the bore establish a closed chamber so that upon continuation of the return stroke the piston shifts the valve from the second position into the first position in which the valve opens the first duct for obtaining a forward and impacting stroke.

3 Claims, 5 Drawing Figures

HYDRAULICALLY OPERATED IMPACTING DEVICE

BACKGROUND OF THE INVENTION

The present invention relates to a hydraulically operated impacting device which includes a casing having chambers, spaces and ducts for a pressurized medium, as well as a piston chamber for receiving reciprocating differential pistons to be used as actuating impact devices for the transmission of impact energy upon an impacting shifting or percussion tool. Moreover, the particular device to which the invention pertains includes a control valve being of sleevelike construction without transverse bore, and arranged concentrically-axially to the impacting or striking piston, the valve being hydraulically movable in one direction, but operated and displaced by the impact piston in the opposite direction.

German printed patent application 2,517,213 discloses a hydraulically operated impacting or striking device having a control valve which is displaced in one direction as stated by the moving piston and responds to the motion of the piston in the opposite direction, whereupon it is actuated by the pressurized fluid of the system such that it is moved in the opposite direction under the hydrostatic pressure of that medium. This particular device has the control valve arranged on the side facing the impact or percussion tool. This arrangement is disadvantaged by the fact that during the entire working stroke, it will be necessary to move the valve as a whole, i.e., one has to move its mass. This of course is detrimental with regard to the acceleration imparted upon the impact piston. Moreover, the control valve will in fact travel a longer path back than the operating piston. This means on the one hand that it has to be separated from the piston, which is an event that occurs differently for different objects to be impacted and struck, and for relatively soft objects this retraction may not even be possible. As a consequence, the control valve and the impact piston may desynchronize. On the other hand, the aforementioned longer travel path of the control valve requires means that it be captured. This means in turn an undue heating of the hydraulic medium. Moreover, the switching of the control valve requires under such circumstances an unduly high or large volume of pressure fluid such as oil.

In order to obtain the requisite chambers for returning the valve, it is guided on the inside as well as on the outside. Tight manufacturing tolerances are required here, and that entails considerable cost. Moreover, an arrangement of the control valve on the side of the impacting tool leads to transverse motion of the impact piston, and in the case of a noncentrical impacting upon the impacting tool, the wear is considerably high. Another disadvantage is the mechanical engagement between impacting piston and control valve, which also leads to a high wear and destruction of control edges involved, which in turn impedes the switchover operation.

DESCRIPTION OF THE INVENTION

It is an object of the present invention to provide a new and improved hydraulically operated impacting striking and percussion device which simplifies the control and matches the speed of the control to the consistency of the object to be impacted upon.

In accordance with the preferred embodiment of the present invention, a hydraulically operated impacting device is suggested to comprise a housing with an axial bore in which is slidably disposed a differential piston, the piston has a rod facing away from an impact surface at one end of the piston. A valve is disposed in the bore, and circumscribes the piston rod, there being an annular space between the rod and the valve; the valve has two postions of operation. In a first position, it opens a duct leading from a pressure source for acting on the larger one of the two piston surfaces of the differential piston, that connection is closed in the alternative one or second one of the valve positions. Another duct structure leads from the source to act on the smaller one of the piston surfaces so that the piston is moved in its return stroke by the latter pressure force as provided by the last-mentioned connection provided the valve closes the aforementioned position. If the valve opens the first-mentioned connection, hydraulic force on account of the differential piston operation overcomes the return stroke producing force. The valve is provided with a collar movable in a ring chamber of the bore, and there is a further duct structure leading from the bore at location below the valve to the latter ring chamber, the piston, however, has a portion which depending upon its position permits or prevents that communication so as to obtain or not to obtain pressurization of the ring chamber for shifting the valve from a position in which the first-mentioned duct is opened to a position in which the first-mentioned duct is closed, permitting therefore the above-mentioned return stroke operation. The piston moreover is to be provided with a collar or pin portion which may enter in parts the annular space during a return stroke while the remainder of the collar and the bore establishes a closed chamber so that upon continuation of the return stroke the piston shifts the valve into the position in which the first-mentioned connection is opened.

In accordance with the invention the control valve is comprised of a single simple sleeve which does not have any transverse bore, which sleeve is particularly controlled for purposes of displacement, namely, it is controlled hydraulically during an impact stroke and mechanically during the reverse stroke in dependence upon displacement and speed of the piston. Moreover, the control valve is maintained hydraulically in defined position inside the casing except during the controlling or changing from forward to reverse stroke and vice versa. The system as such operates with a single pressure oil system.

Particularly shortly before the piston impacts upon the impact tool the further duct structure is opened to the control valve and remains open in the beginning of the return stroke to push the valve in to the second position. Tool and impacted object can be considered theoretically to be a resilient or resilient type system. The consistency of the object being worked upon by the impact tool has an influence upon the return or rebound speed of the piston. For example, if the tool impacts on hard rock, the path or displacement to a complete stop is almost zero. Thus in the case of hard rock a rather high rebound speed is obtained for the impact piston, which in turn means a temporary increase in pressure in the oil. The situation is different for soft rock. Since this pressure is used directly for controlling the valve, for obtaining the return stroke, it can readily be seen that this changeover process occurs much faster in case of impacting on hard objects than on soft objects, which is of course a desirable feature.

Another advantage of the invention is to be seen in the rather simple construction of the impact device as a whole. The control valve has basically the same diameter as a cylinder of the impacting piston with the exception of the various control edges. The housing is basically provided with a single cylindrical bore for receiving the impact piston. In addition, of course there are a plurality of ducts for the control fluid.

Since the control valve circumscribes the impact piston, and here particularly the piston rod, on a side facing away from the impact action, construction of the piston is such that the abutment surfaces of the piston and the housing are separated sufficiently far so that even in the case of a noncentric impact action as far as the piston-tool interaction is concerned, very little skewing occurs so that the piston and the piston guide structure experience very little or no wear.

In order to change the control valve from the return stroke to impact stroke operation, one obtains a mechanical changeover at the end of the return stroke. This mechanical change amounts to a particular direct and exact guidance of the control valve, which likewise is carried out with little or no wear. In particular, as stated, the impact piston has a collar or pin portion penetrating partially into the sleeve of the control valve in a particular phase to thereby trap the pressure oil in a closed chamber. The impact piston shifts the valve, without direct contact with the control valve in the direction of the return stroke. Shortly before the end postion which is the beginning for an impact stroke of the control valve, the piston in effect is decelerated by this trapped pressurized oil. The valve itself moves at a very low speed only, and impacts rather softly upon the front face of the casing, and is maintained by the pressure oil in that position.

Another advantage of the device in accordance with the invention is to be seen in that the piston can be exchanged very easily. Since the diameter of the guide cylinder of the impact piston is smaller than the inner diameter of the sleeve-shaped valve, it is for example possible to remove the impact piston without removing the control valve. Also, as far as the entire arrangement is concerned, very little oil is needed, particularly for obtaining a reversal in piston movement.

DESCRIPTION OF THE DRAWINGS

While the specification concludes with claims particularly pointing out and distinctly claiming the subject matter which is regarded as the invention, it is believed that the invention, the objects and features of the invention, and further objects, features and advantages thereof will be better understood from the following description taken in connection with the accompanying drawings in which:

Proceeding now to the detailed description of the drawings, FIG. 1 primarily but as supplemented by the remaining figures, shows a casing 2 for an impacting device. The casing has a bore 21 which includes an impact striking or percussion piston 3 being in part circumscribed by a sleeve like control valve 4. An impacting striking or percussion tool, such as a chisel, a drill, or the like, is axially disposed in the case, and the impacting piston 3 periodically acts upon this tool 1. FIG. 1 particularly illustrates the instant in which the piston 3 has just impacted upon the tool 1, and is in the process, i.e., in the initial phases of return. The piston 3 has a lower work portion, a first control portion 3' of a larger diameter with a particular control edge 3.1, and a control portion 3" likewise of enlarged diameter separated from the portion 3' by the narrowed portion 3.2, and having in addition a control edge 3.3. Above the control edge 3.3, there is a collar or pin portion 3.4 and a transition portion 3.5. The two portions 3.3 and 3.5 constitute the large surface of this differential piston and 3.1 is the small piston surface. The piston ends in an extended portion or piston rod 3.6.

The control edge and surface 3.1 particularly cooperates with an annular chamber 5' being at the end of a duct portion 5.1, which in turn is an inwardly extending duct portion of the duct 5.2, the latter being connected to an inlet duct 5 for the pressurized medium, i.e. hydraulic fluid such as oil. The control edge 3.3 of the portion 3" cooperates with a duct 7, as well as a duct 6.2. The duct 7 is the principle portion for feeding pressure from the interior of valve 4 to the exterior so as to shift the valve from a first to a second position. An extension 7.1 of duct 7 connects to the bore 21 below the valve 4; an upper extension 7.2 of duct 7 connects to a ring chamber 5'''. In the upper portion of the arrangement, and particularly circumscribing the piston rod 3.6, is the valve 4 which, as stated, is arranged coaxially to the piston 3. The valve has a plurality of control edges and cooperates with various ducts and chambers basically extending between an inlet portion 5 or inlet duct 5 for hydraulic fluid and an outlet 6. As stated, the FIG. 1 illustrates the disposition of the piston just in the beginning of the turn of the impact piston, while FIG. 2 illustrates the beginning of an impact stroke following the return or retraction of the piston.

Figure 1:
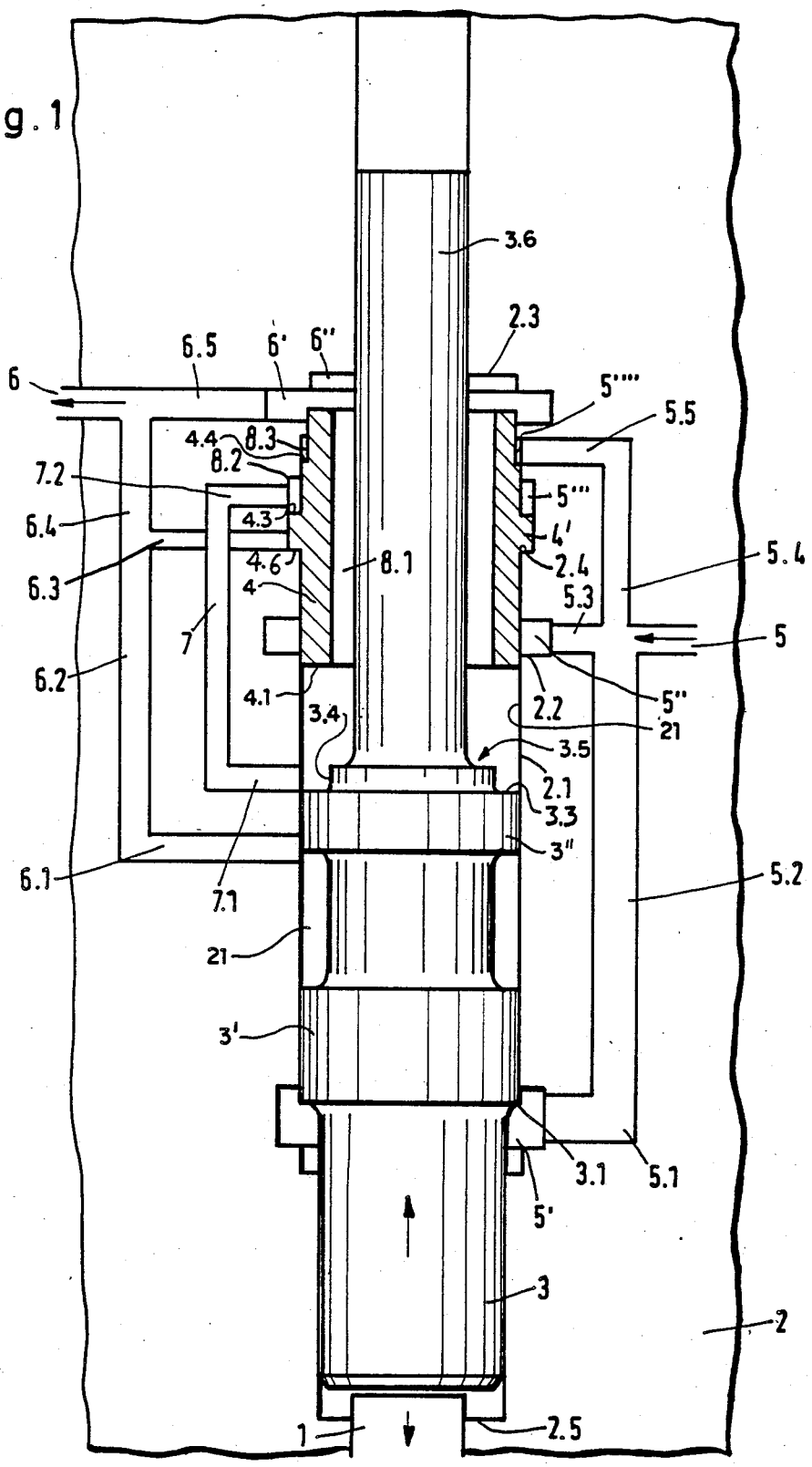
FIG. 1 is an axial section view through an impact device in accordance with the preferred embodiment of the present invention for practicing the best mode thereof, and showing particularly the beginning of a return stroke as far as the depicted impacting piston is concerned a valve being shown in what is called for convenience of reference the second position.

In the particular situation, shown in FIG. 1 as well as during the end phase of an impact stroke the piston portion 3" opens the opening 7.1 for the duct 7. Pressurized oil entered an annular chamber 8.2 through the duct portion 7.2 and the ring chamber 5''', and through the annular surface of the control edge 4.3 of a collar 4' of the control valve, the control valve 4 was moved from the first position to the second position (FIG. 1); i.e. in the direction of the impacting tool 1. Also, the annular surface of the control edge 4.6 of the control valve 4 had abutted against the annular surface 2.4 of the casing. Oil from the lower portion of annular groove 5''' had entered through the middle passage 6.3 and the upper connection 6.4 to the outlet 6. The groove or chamber 5''' is thus a kind of piston chamber in which the collar 4' moves in piston like fashion.

The annular chamber 5'''' is open through an upper connection 5.4 and an upper oil feed portion 5.5 being also connected to duct 5. This way pressurized oil from the inlet duct 5 is enabled to hold the control valve 4 in the second position obtaining return stroke operation, cooperation of the annular surface of the control edge 4.4. The valve 4 in particular is held in this second position during the return stroke even after 3.3 and 3″ have closed again duct 7.1. Thus the pressure of the oil inside the annular space 8.3 maintains the control valve 4 in the second position under utilization of the annular surface of control edge 4.4. The control valve 4 moreover opens the upper annular groove 6″ and the lower annular groove 6′. Oil from the internal annular space 8.1 can now flow through the upper outlet 6.5 to the oil discharge path 6. Simultaneously, the control valve in the second position blocks the annular groove 5″ to thereby interrupt the feeding of pressurized oil through the duct 5.3 to the annular surface pertaining to the piston surface 3.3.

Figure 5:
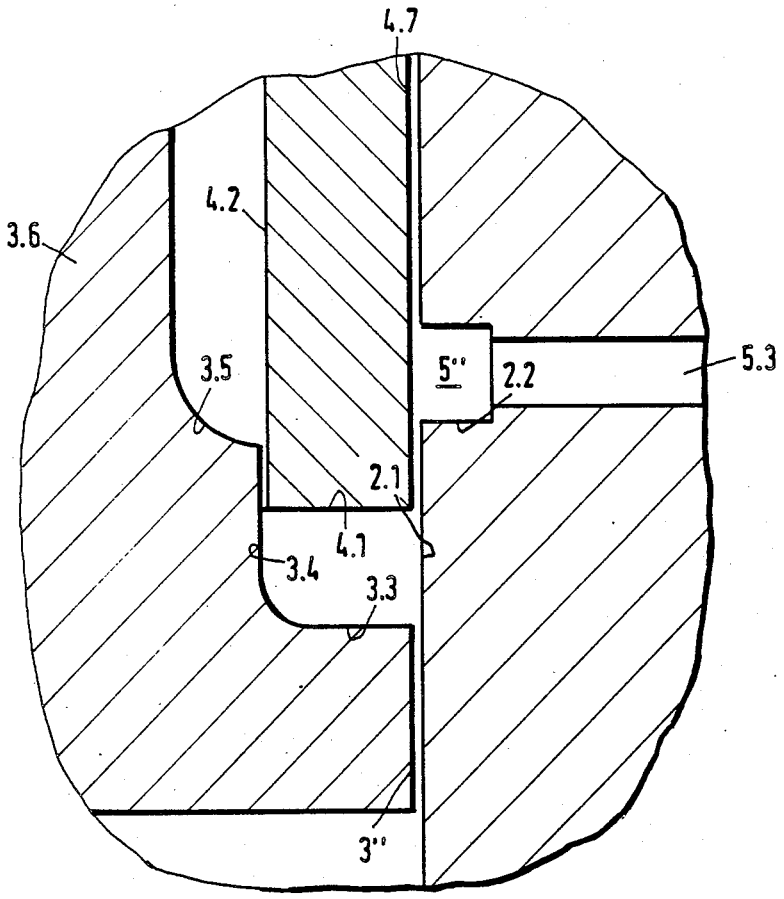
FIG. 5 illustrates in detail the annular space between impacting piston, control valve, and casing of the device shown in FIGS. 1 and 2.

Pressurized oil passes through the connection 5.2 and 5.1 into the lower annular chamber 5′, and acts upon the annular surface 3.1 of the cylinder 3′ to thereby move the impact piston 3 in direction away from the tool 1. This in effect establishes the return stroke of the piston 3. Shortly before the end of this return stroke the piston 3 engages the control valve 4, which in effect is an operating stage shown in greater detail in FIG. 5.

A portion of the outer wall of the pin 3.4 portion of the piston is shifted into an interior bore 4.2 of the control valve 4. Oil now is trapped between the surfaces of the outer wall of collar or pin 3.4; of the annular surface 3.3; of the housing inner wall 2.1; and the annular face of the lower edge 4.1 of the control valve 4. The chamber enclosed by these surfaces traps oil. The overlapping surfaces between the pin 3.4 and the inner bore 4.2, as well as of the middle cylinder 3″ and the housing bore 2.1, seal this space sufficiently for oil to remain trapped. The return stroke of the piston continues and through this latter cushion of trapped oil, the valve 4 is shifted from the second position into the first position shown in FIG. 2.

The sealing surface which is formed from the outer surface 4.7 of the valve and the housing inner wall 2.1 becomes smaller during the retraction of the control valve 4. After the edge 4. (lower axial end) of the valve 4 has passed the control edge 2.2 of the housing 2, pressure is established by the oil in the above-identified annular space through the annular groove 5″.

The pressurized oil acts upon the annular surface 3.3 of the impact piston 3, and thereby decelerates its movement; the control valve has moved into the first position (impact stroke initiation). This position is basically the one shown in FIG. 2. The pressurized oil will now flow into the annular space 8.1 once the collar 3.4 has cleared the control edge 4.1 of the control valve 4. Now the impact piston 3 is accelerated in the direction towards the impacting tool 1 because as far as pressure actuation is concerned, not only does the annular surface 3.3 receive such pressure, but also the annular surface 3.5. The oil in the middle annular groove 5‴ flows to the outlet 6 through the duct 7 and the annular space 3.2.

Figure 2:
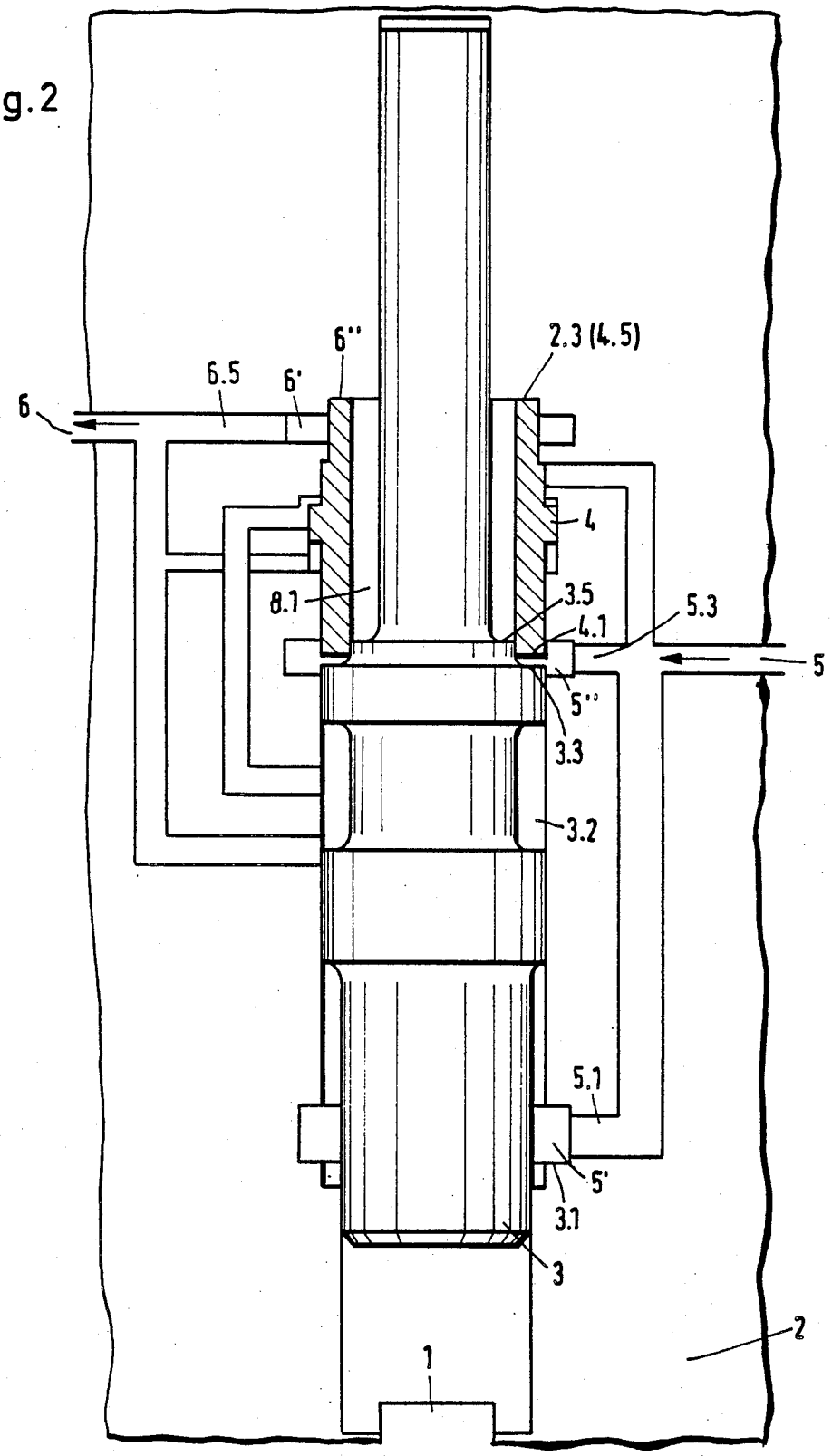
FIG. 2 is a view similar to FIG. 1 but showing the device at the beginning of an impacting stroke, the valve being shown in the first position.
Figure 3:
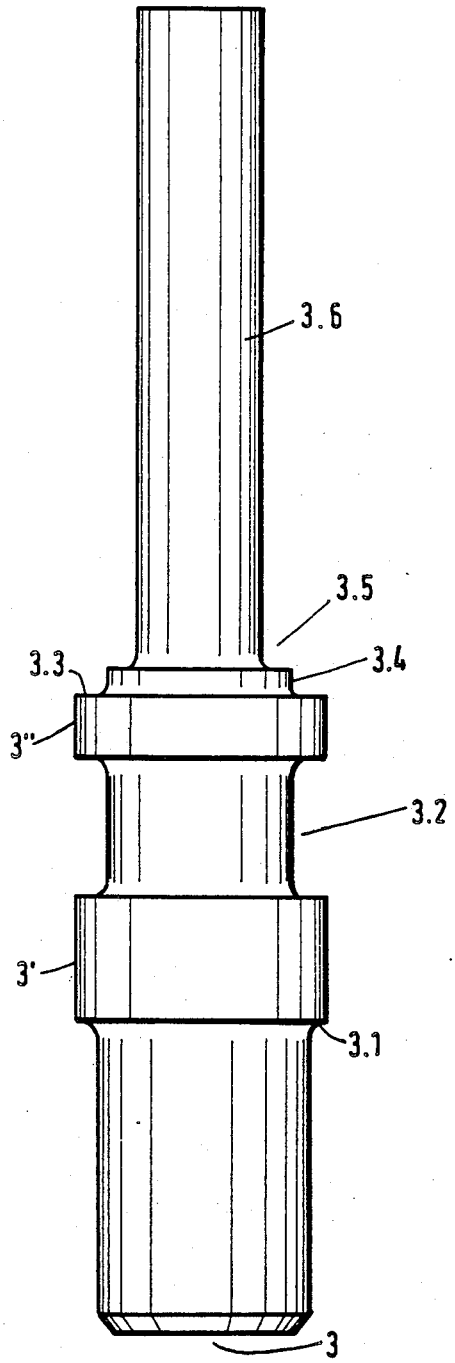
FIG. 3 illustrates a side view of the impacting piston showing in FIG. 1 and FIG. 2.
Figure 4:
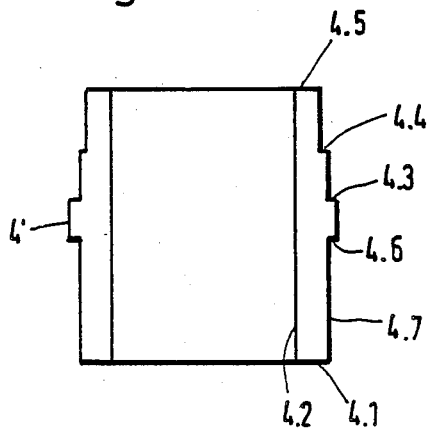
FIG. 4 illustrates somewhat schematically the control valve involved in the systems showing in FIGS. 1 and 2.

As stated, FIG. 2 illustrates the control valve 4 in the position beginning an impacting stroke. The control valve 4 in particular rests by means of its front face 4.5 on the annular face 2.3 of the housing 2. The discharge of the oil from the annular space 8.1 in the upper duct portion 6.5 and the annular duct 6″ and 6′ is interrupted. As soon as the impact stroke begins, collar 3.4 leaves the interior of valve 4 and pressurized oil is passed into the annular space 8.1 through the ducts 5.3 and the annular duct 5″, and thereby reaches the front faces 3.5 and 3.3, facing away from the impacting tool. The oil continues into the feed duct 5.1 of the annular space 5′ at the front face 3.1 facing the impacting tool. Since the annular surfaces 3.3 and 3.5 are significantly larger than the annular face 3.1, this piston 3 acts as a differential piston, and is in this situation accelerated towards the impacting tool 1. After impacting, the return stroke cycle is repeated as was outlined above.

The invention is not limited to the embodiments described above, but all changes and modifications thereof, not constituting departures from the spirit and scope of the invention, are intended to be included.

I claim:

1. Hydraulically operated impacting device comprising:

a housing having an axial bore;

a differential piston slidably disposed in the bore, and having on one hand an impacting surface and having a piston rod facing away from the impacting surface at the other end of the rod, the differential piston having accordingly a smaller and a larger piston surface;

a sleeve-like valve in the bore circumscribing the piston rod, there being an annular space between the rod and the valve, the valve having a first and second position, the sleeve-like valve having a collar, the collar having an annular surface facing away from the impacting device;

first duct means leading from a pressure source to the bore and being governed by the valve for acting or not acting on the larger one of the two piston surfaces respectively in the first and second positions of the valve;

second duct means leading from said source to said bore for acting on the smaller one of the piston surfaces;

third duct means leading from the bore at a location below the valve to a ring chamber adjacent the valve, the collar of the valve being movable in the ring chamber, said piston having a portion which depending on the position of the piston permits or prevents communication between said annular space and said third duct means to obtain or not obtain pressurization of the ring chamber, increased pressurization of the ring chamber obtains as the rod impacts, pressurization of the ring chamber acting on said annular surface of the collar for shifting the valve from the first to the second position; and said piston having a first collar annularly biparting the larger piston surface, the first collar entering in parts the annular space during a return stroke of the piston while the remainder of the first collar, an outer part of the biparted larger piston surface, a lower end of the valve, and the bore establish a closed chamber so that upon continuation of the return stroke the piston shifts the valve from the second position into the first position in which the valve opens said first duct means for obtaining a forward and impacting stroke.

2. Device as in claim 1, there being a venting duct in the housing and an annular space adjacent the end of the valve facing away from the impacting surface of the piston, said venting duct having a diameter slightly larger than the diameter of the latter end of the valve, the valve being shifted into the latter duct means for closing off the venting connection from the annular space between the rod and the valve when the valve is in the first position.

3. Hydraulically operated device as in claim 1 including further duct means cooperating with a holding edge or surface on the valve for holding the valve hydraulically in the second position, the holding force being overcome during said continuation of the return stroke.

* * * * *